US006679246B2

(12) United States Patent
Strolz et al.

(10) Patent No.: US 6,679,246 B2
(45) Date of Patent: Jan. 20, 2004

(54) OVEN WITH DOOR SEAL BETWEEN THE OVEN MUFFLE FLANGE AND THE OVEN DOOR

(75) Inventors: Bernd Strolz, Baden-Baden (DE); Frank Rödelsperger, Höchst (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 0 days.

(21) Appl. No.: 10/151,091

(22) Filed: May 20, 2002

(65) Prior Publication Data

US 2002/0166456 A1 Nov. 14, 2002

Related U.S. Application Data

(63) Continuation of application No. PCT/EP00/10813, filed on Nov. 2, 2000.

(30) Foreign Application Priority Data

Nov. 18, 1999 (DE) ..... 199 55 549

(51) Int. Cl.[7] ..... F23M 7/00; F24B 1/00
(52) U.S. Cl. ..... 126/190; 126/19 R
(58) Field of Search ..... 126/190, 19 R, 126/273 R, 545; 49/475.1, 495.1, 489.1

(56) References Cited

U.S. PATENT DOCUMENTS 4,417,420 A * 11/1983 Marsh ..... 49/482.1
4,512,331 A * 4/1985 Levi ..... 126/190
4,638,788 A * 1/1987 Lancelot ..... 126/198
4,924,072 A * 5/1990 Oslin ..... 219/401
6,220,239 B1 * 4/2001 Kieslinger et al. ..... 126/340
6,227,598 B1 * 5/2001 Ichioka et al. ..... 296/93
6,478,308 B1 * 11/2002 McMillin et al. ..... 277/630

FOREIGN PATENT DOCUMENTS

| | | |
|---|---|---|
| DE | 30 47 380 A1 | 7/1982 |
| DE | 295 02 175.6 U1 | 5/1995 |
| FR | 2 360 850 | 3/1976 |
| FR | 2 524 429 | 3/1982 |
| GB | 1017159 | 1/1966 |

* cited by examiner

*Primary Examiner*—Alfred Basichas
(74) *Attorney, Agent, or Firm*—Laurence A. Greenberg; Werner H. Stemer; Gregory L. Mayback

(57) ABSTRACT

A baking oven includes a seal located between the baking oven muffle flange and the baking oven door. The seal has chambers. The chambers have an elastic lip-like lateral wall, are aligned in a direction toward the adjacent door walls and muffle flange walls, and are open on a side facing away from the seal fastening. When the door is in a closed position, the free lateral walls of the seal rest against and are deflected outward on the door or on the muffle flange wall such that air is ousted from the sealing chambers, thus, causing the sealing chambers to function in a manner similar to that of a suction cup.

18 Claims, 1 Drawing Sheet

OVEN WITH DOOR SEAL BETWEEN THE OVEN MUFFLE FLANGE AND THE OVEN DOOR

CROSS-REFERENCE TO RELATED APPLICATION

This application is a continuation of copending International Application No. PCT/EP00/10813, filed Nov. 2, 2000, which designated the United States and was not published in English.

BACKGROUND OF THE INVENTION

Field of the Invention

The present invention relates to an oven with a seal that has a frame-like configuration, runs between the oven muffle flange and the oven door located in the closed position, is fastened on the muffle flange or the door, and is intended for sealing the oven interior in relation to the outside atmosphere.

British Patent No. GB 1,017,159 discloses a conventional oven with an oven door having a sealing strip made of silicone. The sealing strip includes a flat base section on which two side walls are formed. With the door closed, the side walls are deflected and are in contact with a sealing surface that is provided on a frame of the oven.

French Patent No. FR 2,360,850 discloses a door seal that has a seal chamber formed between two seal side walls. The seal chamber is provided with a connection through which air can be introduced into the chamber.

Ovens with elastic seals that run along the oven muffle flange, around the oven-interior opening, in the direction of the door surface exist to a sufficient extent (e.g., German Patent DE 30 47 380). Such seals are of elastic material with and without enclosed air chambers and with or without sealing lips. Configurations in which the seal is closed all the way round exist; other configurations have gaps through which, for example, it is possible to equalize the air pressure between the oven interior and the outside atmosphere.

Steam ovens are a special type of oven. In these ovens, the oven interior, in order to carry out the cooking process, is enriched with steam that is formed by evaporating water stored in or on the oven chamber or water fed, if required, in portions into the oven chamber. Steam ovens of appropriate construction operate like pressure cookers at a high internal pressure. As a result, precautions have to be taken not only to hermetically seal the interior but also to be secured against unintentional opening. In contrast, steam ovens that operate at more or less atmospheric pressure are more user-friendly. For these ovens, it is sufficient, for example, for the oven door to be held closed in the closed position not such that it is secured with a form fit, but rather with a force fit, in a straightforwardly acting and operable manner. For purposes of clarity, a force-locking connection is one that connects two elements together by force external to the elements, as opposed to a form-locking connection, which is provided by the shapes of the elements themselves. Nevertheless, it is desirable and expedient to have measures that prevent the hot steam atmosphere within the oven chamber from being able to escape outward without being hindered in any way. It is, thus, usually the case that measures are taken for it to be possible for a positive pressure of a few Pascals, e.g., around 5 Pascals, to be established in the oven interior. In the case of such appliances, it is also intended for the door seals between the closed door and the muffle flange to constitute a sufficiently effective barrier for such a change in pressure. It is indeed the case, with an appropriate configuration, that seals that are usually used for ovens without steam operation can also satisfy the set requirements for the abovementioned steam ovens. However, in particular, when pressure surges occur in the oven interior by way of evaporation surges as a result of the pulsating feed of power and/or feed of water, these sealing measures have shortcomings.

SUMMARY OF THE INVENTION

It is accordingly an object of the invention to provide an oven with door seal between the oven muffle flange and the oven door that overcomes the hereinafore-mentioned disadvantages of the heretofore-known devices of this general type and that provides a sealing device for the door region that, in addition to the possibility of using conventional ovens, are suitable, in particular, for use in normal-pressure steam ovens and can be used there in an advantageous manner in relation to the prior art.

With the foregoing and other objects in view, there is provided, in accordance with the invention, an oven including a muffle having a muffle flange, the muffle defining a door opening and an interior, the muffle flange having a surface, a door having a surface, the door moveably connected to the muffle at the door opening between an open position and a closed position, a frame-shaped seal for sealing the interior with respect to the outside atmosphere, the seal disposed between the muffle flange and the door in the closed position, and having two sides including a first side fastened to one of the muffle flange and the door, and a second side facing the surface of another one of the muffle flange and the door, the second side of the seal having elastic seal side walls defining a seal chamber therebetween, the seal side walls having transverse webs subdividing the seal chamber, and the seal chamber reducing in size and displacing air therefrom as the door closes to the closed position, and, when the door is in the closed position, the seal side walls butting against the surface of one of the door and the muffle flange and deflecting to form the seal chamber into at least one suction cup providing a suction force against the surface of one of the door and the muffle flange.

The present invention is based on an oven with a seal between an oven door located in the closed position and the adjacent oven muffle flange. The oven seal is configured with a chamber that is aligned in the direction of the adjacent door and muffle flange walls, is open on its side directed away from the fastening, and has elastic lip-like side walls. With the door located in a closed position, the free seal side walls butt against a smooth surface of the door and/or of the muffle flange wall and are deflected such that air is displaced in the seal chambers and the seal chambers, thus, act in the manner of suction cups, the seal chamber all the way round being subdivided by transverse webs. Such a configuration prevents leakage brought about by a damaged location on the seal, and, thus, total ineffectiveness of the suction-cup behavior.

By virtue of the measure according to the invention, in particular, in conjunction with a force-fitting measure envisaged for holding closed the oven door located in the closed position, it is possible to make use of an additional force-fitting retaining effect by way of the suction-cup-like action, which improves not only the closing behavior but also the sealing behavior.

In the case of steam ovens that operate at a slightly elevated internal pressure of approximately 4 Pascals, and in the case of which internal-pressure surge peaks of up to 10

Pascals and just above can occur as a result of steam surges with the intermittent supply of energy and/or water, the sealing measure according to the invention is particularly suitable for absorbing these brief surges elastically without adversely affecting the sealing function.

In accordance with another feature of the invention, the surface of the muffle flange and/or the surface of the door are smooth.

In accordance with a further feature of the invention, the first side is fastened to the muffle flange, the surface of the door is smooth, and the second side faces the smooth surface of the door.

In accordance with an added feature of the invention, the first side is fastened to the door, the surface of the muffle flange is smooth, and the second side faces the smooth surface of the muffle flange.

In accordance with an additional feature of the invention, the seal side walls are lip-shaped.

In accordance with yet another feature of the invention, the muffle and the door form a steam oven having an internal pressure elevated with respect to ambient pressure.

In accordance with yet a further feature of the invention, there is provided a pulsed water feed for producing steam in the steam oven In accordance with yet an added feature of the invention, the seal side walls are two elastic, lip-shaped walls defining a continuous seal chamber traversing entirely around the door opening.

In accordance with yet an additional feature of the invention, the invention is configured to the effect that the elastic lip-like seal walls are aligned obliquely between the door and the muffle flange wall. Preferably, at least the seal wall that is directed toward the muffle interior is aligned obliquely from the fastening location in the direction of the muffle interior. Such a configuration achieves favorable abutment of the lip-like elastic seal walls on the opposite abutment surface and, furthermore, also reduces the closing pressure to which the door is to be subjected because the obliquely positioned seal walls can slide off laterally, rather than being compressed, and the chamber with suction-cup-like action is, thus, also specifically reduced in size, as is the volume of air enclosed.

In accordance with again another feature of the invention, the seal is expediently fastened on the oven muffle flange, for example, with a form fit or by an adhesive device, and, with the door located in the closed state, the free ends of the elastic lip-like seal walls butt against a glass panel of the oven door, the glass panel being configured to extend beyond the muffle opening. Such a measure achieves functionally reliable sealing, which is of straightforward construction, in the region between the oven door and oven muffle flange.

In accordance with a concomitant feature of the invention, the door has an interior side and a glass panel on the interior side, the door opening has edges, the glass panel extends beyond the edges of the door opening when the door is in the closed position, the seal side walls each have free ends, and the free ends of the seal side walls butt against the glass panel when the door is in the closed position.

Other features that are considered as characteristic for the invention are set forth in the appended claims.

Although the invention is illustrated and described herein as embodied in an oven with door seal between the oven muffle flange and the oven door, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
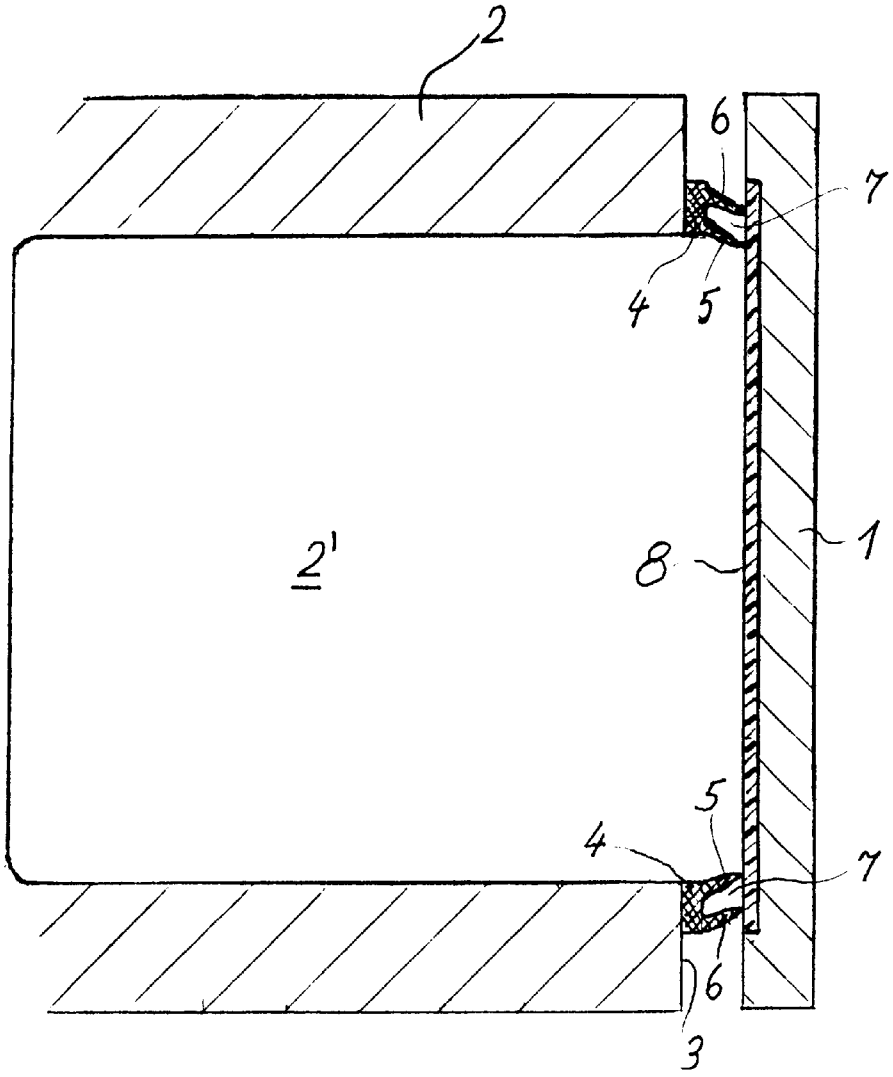
FIG. 1 is a fragmentary, cross-sectional view of an oven muffle with a door according to the invention.

Referring now to the figures of the drawings in detail and first, particularly to FIG. 1 thereof, there is shown a steam-cooking muffle 2 closed by a door 1. A seal 4 made of silicone is fastened on the muffle flange 3, all the way round the opening of the muffle interior 2'. Formed between two obliquely projecting seal walls 5 and 6 is a chamber 7 that is reduced in size as the door 1 closes, the free ends of the seal walls 5 and 6 coming into abutment in the region of a glass panel 8 that, as a constituent part of the door 1, is configured to extend beyond the opening of the muffle interior 2. In the definitive closed position of the door 1, the effective cavity of the chamber 7 between the wall lips 5 and 6 is reduced in size to such an extent that, despite heating, in the case of a slight build-up in pressure, in particular, with some degree of surging, in the oven interior 2, elastic yielding of the door counteracts the pressure peaks without the sealing action by the silicone seal 4 being impaired or eliminated.

Figure 2:
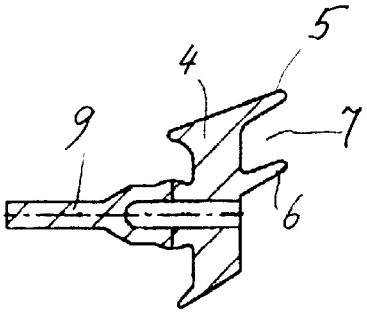
FIG. 2 is a cross-sectional view of a seal with fastening protrusions according to the invention.

FIG. 2 illustrates a cross section of a silicone seal 4 with the lip-like seal walls 5 and 6. Fastening protrusions 9 are provided at small intervals on the bottom of the silicone seal 4 and, in non-illustrated holes of the muffle flange 3, are used for fastening to the muffle flange 3.

The seal walls 5 and 6 have transverse webs 10 subdividing the chamber 7 all the way around the opening of the muffle interior 2'. In the closed position of the door 1 with the seal walls 5 and 6 abutting the glass panel 8, the seal walls 5 and 6 are deflected, which displaces air in the chambers 7. Therefore, the chambers 7 act as suction cups. The chamber 7 is subdivided all the way around the opening of the muffle 2'. Such a configuration prevents leakage brought about by a damaged location on the seal 4, and thus, total ineffectiveness of the suction-cup behavior.

We claim:

1. An oven, comprising:

a muffle having a muffle flange, said muffle defining a door opening and an interior, said muffle flange having a surface;

a door having a surface, said door moveably connected to said muffle at said door opening between an open position and a closed position;

a frame-shaped seal for sealing said interior with respect to the outside atmosphere, said seal:

disposed between said muffle flange and said door in said closed position; and having two sides including a first side fastened to one of said muffle flange and said door, and a second side facing said surface of another one of said muffle flange and said door;

said second side of said seal having elastic seal side walls defining a seal chamber therebetween;

said seal side walls having transverse webs subdividing said seal chamber; and said seal chamber reducing in size and displacing air therefrom as said door closes to said closed position, and, when said door is in said closed position, said seal side walls butting against said surface of one of said door and said muffle flange and deflecting to form said seal chamber into at least one suction cup providing a suction force against said surface of one of said door and said muffle flange.

2. The oven according to claim 1, wherein said surface of said muffle flange is smooth.

3. The oven according to claim 1, wherein said surface of said door is smooth.

4. The oven according to claim 1, wherein:

said first side is fastened to said muffle flange;

said surface of said door is smooth; and said second side faces said smooth surface of said door.

5. The oven according to claim 1, wherein:

said first side is fastened to said door;

said surface of said muffle flange is smooth; and said second side faces said smooth surface of said muffle flange.

6. The oven according to claim 1, wherein said seal side walls are lip-shaped.

7. The oven according to claim 1, wherein said muffle and said door form a steam oven having an internal pressure elevated with respect to ambient pressure.

8. The oven according to claim 7, including a pulsed water feed for producing steam in said steam oven.

9. The oven according to claim 1, wherein:

said seal traverses entirely around said door opening of said muffle;

said seal side walls are two elastic, lip-shaped walls defining a continuous seal chamber traversing entirely around said door opening.

10. The oven according to claim 1, wherein said seal side walls are disposed obliquely between said door and said muffle flange.

11. The oven according to claim 1, wherein said seal side walls project at an oblique angle from said seal.

12. The oven according to claim 1, wherein said seal side walls project from said surface of one of said muffle flange and said door at an oblique angle.

13. The oven according to claim 1, wherein one of said seal side walls closer to said interior extends obliquely in a direction towards said interior.

14. The oven according to claim 1, wherein one of said seal side walls closer to said interior extends obliquely from said first side of said seal in a direction towards said interior.

15. The oven according to claim 1, wherein said seal is fastened to said muffle flange.

16. The oven according to claim 15, wherein:

said door has an interior side and a glass panel on said interior side;

said door opening has edges;

said glass panel extends beyond said edges of said door opening when said door is in said closed position;

said seal side walls each have free ends; and said free ends of said seal side walls butt against said glass panel when said door is in said closed position.

17. In an oven having a muffle with a muffle flange, the muffle defining a door opening and an interior, the muffle flange having a surface, and a door having a surface, the door moveably connected to the muffle at the door opening between an open position and a closed position, a sealing device comprising:

a frame-shaped seal for sealing the interior with respect to the outside atmosphere, said seal:

disposed between the muffle flange and the door in the closed position; and having two sides including a first side fastened to one of the muffle flange and the door, and a second side facing the surface of another one of the muffle flange and the door;

said second side of said seal having elastic seal side walls defining a seal chamber therebetween;

said seal side walls having transverse webs subdividing said seal chamber; and said seal chamber reducing in size and displacing air therefrom as the door closes to the closed position, and, when the door is in the closed position, said seal side walls butting against the surface of one of the door and the muffle flange and deflecting to form said seal chamber into at least one suction cup providing a suction force against the surface of one of the door and the muffle flange.

18. In combination with an oven having a muffle with a muffle flange, the muffle defining a door opening and an interior, the muffle flange having a surface, and a door having a surface, the door moveably connected to the muffle at the door opening between an open position and a closed position, a sealing device comprising:

a frame-shaped seal for sealing the interior with respect to the outside atmosphere, said seal:

disposed between the muffle flange and the door in the closed position; and having two sides including a first side fastened to one of the muffle flange and the door, and a second side facing the surface of another one of the muffle flange and the door;

said second side of said seal having elastic seal side walls defining a seal chamber therebetween;

said seal side walls having transverse webs subdividing said seal chamber; and said seal chamber reducing in size and displacing air therefrom as the door closes to the closed position, and, when the door is in the closed position, said seal side walls butting against the surface of one of the door and the muffle flange and deflecting to form said seal chamber into at least one suction cup providing a suction force against the surface of one of the door and the muffle flange.

* * * * *